United States Patent [19]

Sayles

[11] Patent Number: 4,758,387

[45] Date of Patent: Jul. 19, 1988

[54] DISPOSAL OF SOLID PROPELLANTS

[75] Inventor: David C. Sayles, Huntsville, Ala.

[73] Assignee: The United States of America as represented by the Secretary of the Army, Washington, D.C.

[21] Appl. No.: 898,576

[22] Filed: Apr. 21, 1978

Related U.S. Application Data

[63] Continuation-in-part of Ser. No. 776,442, Mar. 10, 1977, abandoned.

[51] Int. Cl.[4] ..... C06B 45/10

[52] U.S. Cl. ..... 264/3.1; 149/19.92; 149/109.6

[58] Field of Search ..... 149/105, 19.92, 109.6; 264/3 R

[56] References Cited

U.S. PATENT DOCUMENTS

| | | | |
|---|---|---|---|
| 1,706,938 | 3/1929 | Roberts | 149/109.6 |
| 3,778,320 | 12/1973 | Yosim et al. | 149/109.6 |
| 3,897,237 | 7/1975 | Musselman et al. | 149/19.92 |
| 3,968,723 | 7/1976 | Falterman et al. | 149/109.6 |
| 4,038,116 | 7/1977 | Andrews et al. | 149/105 |
| 4,057,442 | 11/1977 | Shaw et al. | 149/19.92 |
| 4,098,627 | 7/1978 | Tompa et al. | 149/109.6 |
| 4,198,209 | 4/1980 | Frosch | 149/108.4 |
| 4,229,182 | 10/1980 | Frosch | 149/108.4 |

*Primary Examiner*—Edward A. Miller

*Attorney, Agent, or Firm*—William G. Gapcynski; Werten F. W. Bellamy; James T. Deaton

[57] ABSTRACT

Solid propellant is first placed in a closed container with a solution of water and detergent. A water slurry is then created by injecting compressed air in superheated steam into the solution to place the propellant and solution under several atmospheres of pressure and at the same time to raise the temperature of the solution to 400°-600° F. This results in oxidation of the propellant into such constituents as carbon dioxide, water, nitrous oxide and etc. These constituents are then removed by absorption.

5 Claims, No Drawings

DISPOSAL OF SOLID PROPELLANTS

DEDICATORY CLAUSE

The invention described herein may be manufactured and used by or for the Government for governmental purposes without the payment of any royalty thereon.

CROSS REFERENCE TO RELATED APPLICATION

This application is a continuation-in-part of copending application Ser. No. 776,442 filed Mar. 10, 1977, now abandoned.

BACKGROUND OF THE INVENTION

1. Field of the Invention

This invention generally relates to the disposal of outdated solid propellants and deals, more specifically, with the reduction of outdated solid propellants in a manner which does not cause atmospheric pollution and which is safe and reliable.

2. Description of the Prior Art

The prior art discloses many techniques for the reduction and disposal of solid propellants. U.S. Pat. No. 2,964,429 relates to a process for the removal of leaded and carboraceous deposits such as combustion residues, and particularly combustion residues which contain lead or lead compounds. The method described includes the steps of precleaning, rinsing, deleading, rinsing, decarbonizing, rinsing the solvent, and a final rinse with water.

In U.S. Pat. No. 3,440,096, a method of removing propellants from a rocket engine by means of inserting a pair of angularly related revolving fluid jets is taught. The jets erode a swath through the propellant. Jets directed in a reverse direction provide a stream which flushes spent fluid and waste from the cylinder of the rocket through the access by which the jets entered.

A similar type of method is described in U.S. Pat. No. 3,312,231. Illustrated is a different type of nozzle arrangement used for the flushing of solid propellants from the casings of rocket motors.

SUMMARY OF THE INVENTION

When the solid propellant is prepared for disposal, any closure disks which appear on the rocket casing are removed. The solid propellant is then placed in a tank which can withstand pressure and heat. The propellant is covered with a solution of water and detergent and compressed air and superheated steam and then added through the solution so that the temperature of the solution is elevated and the tank is pressurized. This causes the reduction of the propellant into such constituents as carbon dioxide, water, nitrous oxide and etc. These constituents are then removed by any convenient method, such as absorption in a purification tower using counterflowing aqueous alkali.

It is an object of this invention to provide a method for the disposal of propellants which is safe and reliable.

It is a further object of this invention to provide a method of reducing solid propellants which does not create any atmospheric pollution or otherwise adversely affect the environmental area.

It is a further object of this invention to provide a method of destruction of outdated solid propellants which does not cause destruction of the rocket casing.

DESCRIPTION OF THE PREFERRED EMBODIMENT

A method of disposing of solid propellants has been discovered that is useful in disposing of all presently known disposable solid propellants with military application. These solid propellants include composite propellants, composite-modified double base propellants, double-base propellants, difluoramino-based propellants and etc.

Table I below contains a composition of a composite, ultrahigh burning rate propellant that has been used in establishing the effectiveness of this method toward destroying solid propellants without resorting to the hazardous process of burning the propellant.

TABLE I

COMPOSITION OF A PROPELLANT USED IN DEMONSTRATING THE EFFECTIVENESS OF THIS DISPOSAL METHOD

| PROPELLANT INGREDIENT | COMPOSITION (WEIGHT %) |
|---|---|
| Ultrafine Ammonium Perchlorate (1.0 μm) | 55.0 |
| Ammonium Perchlorate (70 μm) | 18.0 |
| Aluminum Powder (20 μm) | 9.0 |
| Aluminum Flake (Alcoa 609) | 3.0 |
| Normal-Hexylcarborane | 9.0 |
| Hydroxyl-Terminated Polybutadiene Prepolymer BA-114* | 4.953 |
| Trimethylolpropane | 0.3 |
| Triphenylbismuthine | 0.06 |
| Isophorone Diisocyanate | 0.03 |
| | 0.0657 |

*The reaction product of 12-hydroxystearic acid and tris(2-methylaziridinyl)-phosphine oxide If a rocket motor which is to be destroyed is fitted with a closure disk, the disk is removed. The rocket motor or disposable solid propellant, as the case may be, is then placed in a large tank which can withstand pressure of several atmospheres and temperatures in the range of 400°-600° F. The tank is then closed and filled with a solution of water and detergent to cover the solid propellant.

Alkaterge C, a substituted oxazoline, commercially produced by Commercial Solvents Corportation as identified in "Detergents and Emulsifiers Annual" copyrighted 1965 by John W. McClutcheon, Incorporated, 236 MT. Kemble Avenue, Morristown, N.J., and further indentified in the 8th edition of the "Condensed Chemical Dictionary" page 28 under the title "Alkaterge-C" with the specific properties of the material or Triton X-100, commercially produced by Rohm & Haas Company under the chemical name isooctyl phenyl polyethoxy ethanol as identified in "Detergents and Emulsifiers Annual" copyrighted 1965 by John W. McCutcheon, Incorporated, 236 MT. Kemble Avenue, Morristown, N.J. and further identified by its properties in the 8th edition of the "Condensed Chemical Dictionary" page 484 as isooctylphenoxypolyoxyethylene ethanol with the specific properties thereof (in a concentration of 0.5% by weight of the solution) are some such detergents that can be used in this invention. Other conventional detergents can be used. The detergent acts as a wetting agent to enable the water and steam to better come in contact with the propellant ingredients.

Compressed air in superheated steam is then added to the tank through the solution so that the closed tank is placed under several atmospheres of pressure and preferably for example, from about 5 to about 10 atmospheres and so that the temperature of the solution is raised to 400°-600° F. The pressure of from 5 to 10 atmospheres is controlled by a relief valve on the tank when the desired pressure is exceeded.

The disposable propellant, now under pressure and at an elevated temperature, is reduced to non-noxious constituents such as carbon dioxide, water, nitrous oxide and etc. to form a slurry. The detergent in the solution speeds or accelerates agitation as the air and stream are introduced through the solution.

These slurry constituents can now be removed by any convenient absorption process to provide a complete, reliable and safe method of disposal of outdated solid propellants without atmospheric pollution.

One such method of removal of the constituents from the slurry is by passing the resulting disposed propellant through a purification tower which uses counterflowing aqueous alkali to absorb the constituents.

The effectivity of this method is due to the fact that several of the propellant constituents are either dissolved out of the propellant matrix by the high-pressure, high-temperature steam as it is introduced through the solution or are hydrolyzed by the steam as it enters through the solution. As has been previously pointed out, the pressures at which this method is carried out is from about 5 to about 10 atmospheres. Since the rate of destruction is directly proportional to the pressure, the higher the pressure, the shorter will be the time required to effect the destruction of a particular batch of disposable or waste propellant. This invention merely involves operating the equipment in carrying out the method until complete breakdown of the explosive propellant material takes place. The method of this invention can handle the disposal of several kilograms of the propellant material in 1-2 hours. This is a considerable improvement in the art.

Although I have here described the preferred embodiment of my novel invention, many variations and modifications will now be apparent to those skilled in the art, and I therefore prefer to be limited, not by the specific disclosure herein, but only by the appending claims.

I claim:

1. A method for the disposal of solid propellants comprising the steps of: placing solid propellant and a solution of water and detergent in a closed container with the solution covering the solid propellant; adding compressed air in superheated steam into the solution so that the solution and solid propellant are under several atmospheres of pressure up to about 10 atmospheres, and so that the temperature of the solution is raised sufficiently to break down the solid propellant into constituents and thereby create a water slurry; and removing of the constituents.

2. The method of disposal of solid propellants described in claim 1 wherein said detergent is selected from the group consisting of a substituted oxazoline and isooctyl phenyl polyethoxy ethanol, and wherein said detergent is present in said solution in a concentration of about 0.5% by weight.

3. The method of disposal of solid propellants as described in claim 1 wherein removing of constituents includes treating said water slurry with a purification tower using counterflowing aqueous alkali.

4. The method of disposal of solid propellants as described in claim 1 wherein the temperature of the solution is raised to a temperature within the range of 400°-600° F.

5. A method of disposal of solid propellants as described in claim 1, wherein said detergent is isooctyl phenyl polyethoxy ethanol, wherein the temperature of the solution is raised to 400°-600° F., and wherein removing of constituents includes treating the water slurry with a purification tower using counterflowing aqueous alkali.

* * * * *